US012370595B2

(12) United States Patent
Murase et al.

(10) Patent No.: US 12,370,595 B2
(45) Date of Patent: Jul. 29, 2025

(54) METHOD FOR MANUFACTURING CONTAINER AND APPARATUS FOR MANUFACTURING CONTAINER

(71) Applicant: Toyo Seikan Co., Ltd., Tokyo (JP)

(72) Inventors: Takeshi Murase, Yokohama (JP); Shouta Tanaka, Yokohama (JP); Nobuhiro Sasajima, Yokohama (JP); Erika Sato, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 307 days.

(21) Appl. No.: 18/123,077

(22) Filed: Mar. 17, 2023

(65) Prior Publication Data

US 2023/0226586 A1 Jul. 20, 2023

Related U.S. Application Data

(63) Continuation of application No. PCT/JP2021/028056, filed on Jul. 29, 2021.

(30) Foreign Application Priority Data

Sep. 23, 2020 (JP) ..... 2020-158733

(51) Int. Cl.
*B21D 22/28* (2006.01)
*B21D 26/049* (2011.01)
*B21D 51/16* (2006.01)

(52) U.S. Cl.
CPC ..... *B21D 22/28* (2013.01); *B21D 26/049* (2013.01); *B21D 51/16* (2013.01)

(58) Field of Classification Search
CPC ..... B21D 22/28; B21D 51/26; B21D 51/18
See application file for complete search history.

(56) References Cited

U.S. PATENT DOCUMENTS 4,263,800 A * 4/1981 Arfert ..... B21D 51/2646 72/349
4,779,442 A * 10/1988 Welsh ..... B21D 22/28 72/347

(Continued)

FOREIGN PATENT DOCUMENTS

JP 7-57395 B2 6/1995
JP 2790072 B2 8/1998

(Continued)

OTHER PUBLICATIONS

International Search Report dated Oct. 12, 2021, issued in counterpart International Application No. PCT/JP2021/028056. (2 pages).

*Primary Examiner* — Debra M Sullivan
(74) *Attorney, Agent, or Firm* — WHDA, LLP

(57) ABSTRACT

A manufacturing a container makes it possible to easily manufacture a container including a body portion with a shape that expands outward toward an upper face side. A method for manufacturing a container according to the disclosure is a method for manufacturing a container made of metal, including a bottom portion and a body portion, open on the upper face side, and having a shape in which the body portion expands outward toward the upper face side. The method includes a bottom drawing step of reducing a diameter of a cup body made of metal and having a bottomed cylindrical shape by operating a diameter reducing die having a hole portion with a smaller diameter than an outer diameter of the cup body along a cylindrical axis direction from a bottom side, in which the bottom drawing step is repeated a plurality of times.

15 Claims, 9 Drawing Sheets

(56) References Cited

U.S. PATENT DOCUMENTS

| | | | |
|---|---|---|---|
| 2004/0194522 | A1 | 10/2004 | Hamstra et al. |
| 2018/0141733 | A1 | 5/2018 | Hirayama et al. |

FOREIGN PATENT DOCUMENTS

| | | | |
|---|---|---|---|
| JP | 2003-128060 | A | 5/2003 |
| JP | 2004-202541 | A | 7/2004 |
| JP | 2006-224113 | A | 8/2006 |
| JP | 2011-236970 | A | 11/2011 |
| JP | 107848657 | B | 8/2020 |

* cited by examiner

METHOD FOR MANUFACTURING CONTAINER AND APPARATUS FOR MANUFACTURING CONTAINER

TECHNICAL FIELD

The disclosure relates to a method for manufacturing a container made of metal, open on an upper face side, and including a bottom portion and a body portion and to an apparatus for manufacturing a container.

BACKGROUND

In recent years, in order to conserve resources, reduce waste, and the like, there has been a growing demand for a lightweight, inexpensive, and easily recyclable container that can be used as an alternative to a container made of paper, plastic, or the like.

It is conceivable to adapt a well-known container made of metal and open on an upper face side, which is used as tableware or as a container for filling beverages, food, or the like (refer to JP 2003-128060 A, etc.).

As known containers open on an upper face side, containers made of metal that are washed and used many times, such as those used for tableware, are well known. However, because of the need to increase durability in consideration of long-term use, a certain plate thickness is necessary to increase strength, resulting in higher material costs and molding costs and a heavier weight, thus making the container a highly problematic alternative to containers made of paper, plastic, or the like.

In recent years, the recycling capabilities for metal can containers have improved, and using metal containers made of thin materials, such as the one in JP 2003-128060 A, can now reduce material costs and molding costs and has a lighter weight, while saving resources and reducing waste, even if used only once as tableware.

Nevertheless, there is a problem in that a container made of metal and having an open upper face side is not suitable in shape or structure for being stored and transported while empty and being used by a user while open.

Further, the growing global awareness of the need to prevent environmental pollution, such as the ongoing pollution of the oceans caused by plastics, has led to a demand for containers made of a material that can be easily recovered for recycling.

On the other hand, manufacturing a container made of metal and open on an upper face side requires a technique for forming a body portion into a tapered shape as disclosed in JP 2006-224113 A and the like. However, the conventional method for manufacturing beverage cans is to form a tapered shape only in a partial range in a height direction of the body portion, such as a neck and chime, and no method has been established to form a smooth tapered shape over a wide height range of approximately from 70% to 90% of the body portion of the container.

SUMMARY

An object of the disclosure is to solve the problems described above, and to provide a method for manufacturing a container and an apparatus for manufacturing a container, by which it is possible to easily manufacture a container having a body portion with a shape that expands outward toward an upper face side of the body portion.

A method for manufacturing a container according to the disclosure is a method for manufacturing a container made of metal, including a bottom portion and a body portion, open on an upper face side, and having a shape in which the body portion expands outward toward the upper face side. The problem is solved by including a bottom drawing step of reducing a diameter of a cup body made of metal and having a bottomed cylindrical shape by operating a diameter reducing die having a hole portion with a smaller diameter than an outer diameter of the cup body along a cylindrical axis direction from a bottom side, and repeating the bottom drawing step a plurality of times.

An apparatus for manufacturing a container according to the disclosure is an apparatus for manufacturing a container made of metal, including a bottom portion and a body portion, open on an upper face side, and having a shape in which the body portion expands outward toward the upper face side. The apparatus includes a plurality of bottom drawing dies including diameter reducing dies that have hole portions with smaller diameters than an outer diameter of a cup body made of metal and having a bottomed cylindrical shape and are configured to reduce a diameter of the cup body along a cylindrical axis direction from a bottom side.

According to the method for manufacturing a container according to one aspect and the apparatus for manufacturing a container according to another aspect, by repeating the bottom drawing step of reducing the diameter of the cup body made of metal and having the bottomed cylindrical shape a plurality of times, the diameter of the cup body can be reduced without causing damage such as wrinkles or cracks to the cup body. Thus, even when a wide height range of the body portion of the container is tapered, it is possible to easily manufacture a container with a desired smooth tapered body portion that expands outward toward the upper face side and is made of metal and easily recycled. In addition, since it is not necessary to operate the diameter reducing die with a long stroke, the manufacturing facility can be downsized and the manufacturing process can be sped up.

According to the method for manufacturing a container according to another aspect and the apparatus for manufacturing a container according to another aspect, a diameter of a hole portion of a diameter reducing die used in a bottom drawing step performed earlier is greater than a diameter of a hole portion of a diameter reducing die used in a bottom drawing step performed subsequently, so that the body portion of the container can be reliably formed into a tapered shape over a wide height range.

According to the method for manufacturing a container according to another aspect, and the apparatus for manufacturing a container according to another aspect, by placing a core tool inside the cup body or by applying pressure to the inside of the cup body by inflow of gas into the cup body, the container having the desired smooth tapered body portion can be reliably manufactured.

According to the method for manufacturing a container according to another aspect and the apparatus for manufacturing a container according to another aspect, by repeating the bottom drawing step from 5 to 40 times, the body portion of the container can be reliably formed into the tapered shape over the wide height range.

According to the method for manufacturing a container according to another aspect, by forming the body portion so that a line connecting an outer peripheral face at 10% height and an outer peripheral face at 90% height from a lowermost portion expands outward at an angle of from 2° to 15°, preferably from 3° to 10° (body taper angle) when a total height of the container is 100%, the container can be manufactured with a shape that has high strength, is easy to stack, and is easy for a user to hold, while suppressing toppling when the center of gravity is raised by containing beverages or the like. Containers formed with the body taper angle of more than 15° increase the distance between adjacent containers when arranged in upright postures, resulting in inefficient storage. On the other hand, containers formed with the body taper angle of less than 2° are difficult to separate when stacked containers are separated because the stacked containers stick to each other or the like.

Further, according to the container manufactured in this way, when the two containers are stacked, a projecting portion of the container placed above projecting from the container placed below has a height of 20 mm or less from an upper end of the container placed below, so that the height of a plurality of stacked containers can be reduced.

Furthermore, when transporting and transferring containers to a facility for filling beverages, food, or the like, a lid attachment facility, or the like, the containers can be transported and transferred in a stacked state, thereby improving efficiency when cans are manufactured or the like by filling beverages, food, or the like, and then sealing the filled cans.

According to the configuration described in another aspect, by making the thickness of the bottom portion 0.20 mm or greater, the center of gravity can be lowered. Thus, the containers can be manufactured with good self-standing stability.

Further, the thickness of the bottom portion is 0.35 mm or less, and the thickness of the body portion is from 0.10 to 0.22 mm in a height range of 50±10% when the total height of the container is 100%. This makes it possible to reduce the material costs and the forming costs and lighten the weight, and obtain a container that is formed into a shape in which a line connecting an outer peripheral face at 10% height and an outer peripheral face at 90% height from the lowermost portion expands upward and outward at an angle of from 3° to 10° when the total height of the container is 100% (a more suitable shape).

According to the configuration described in another aspect, by setting a ratio of the projecting portion to a height of the container to be from 4% to 15%, the volume can be reduced while ensuring ease of separation by preventing the containers from sticking or the like when a plurality of containers are stacked, thereby improving efficiency when storing and transporting empty containers. The ratio of the above-described projecting portion to the height of the container is preferably 5% to 9%.

According to the configuration described in another aspect, by making the body portion have a contact portion that prevents the body portion from close contact with another container by reducing the contact area with the other container, it is possible to obtain containers in which the body portions are reliably prevented from coming into close contact with each other when a plurality of containers are stacked, and that are further improved in ease of separation because the portions other than the contact portion are non-contact and circulation of air between the containers can be ensured when individually separating the stacked plurality of containers.

DESCRIPTION OF EMBODIMENTS

A container manufactured by a method for manufacturing a container according to the disclosure will be described below.

Figure 1:
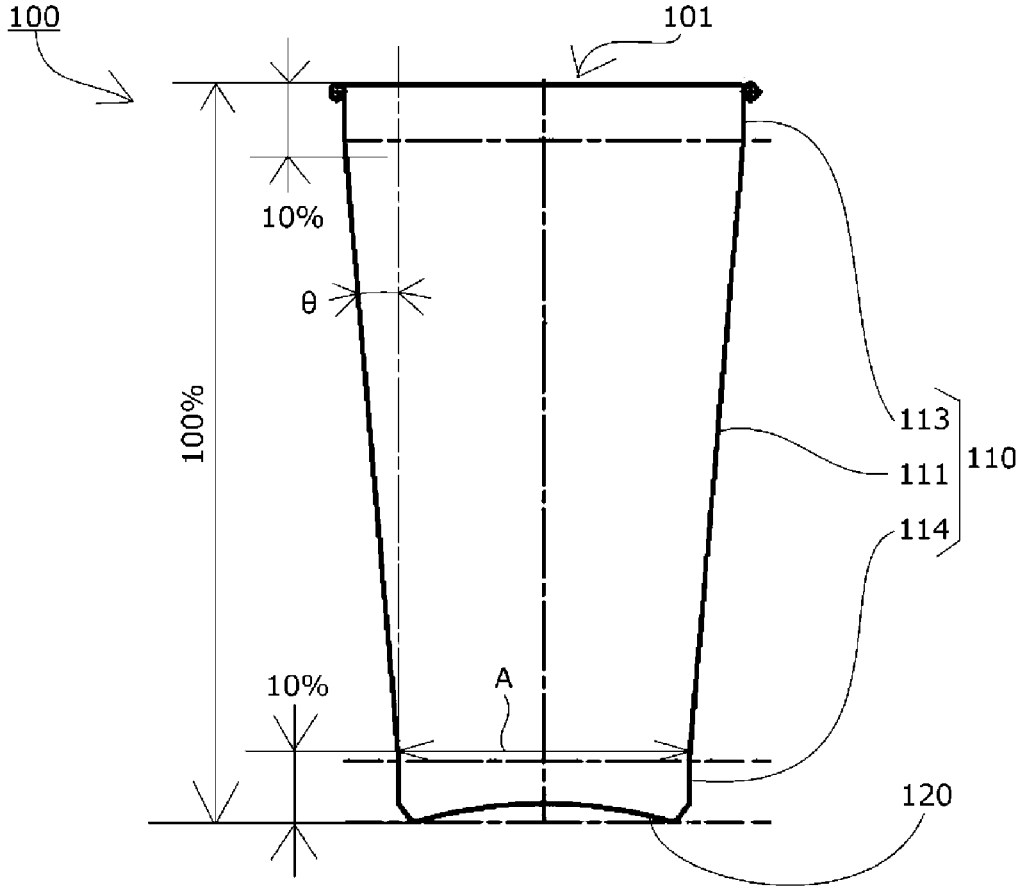
FIG. 1 is a side view of a container manufactured by a method for manufacturing a container according to an embodiment of the disclosure.

As illustrated in FIG. 1, the container manufactured by the method for manufacturing a container according to the disclosure is a container 100 that includes a bottom portion 120 and a body portion 110, is made of metal, has an upper opening 101 open on an upper face side, and can be replaced in shape with a well-known paper cup or plastic cup.

The body portion 110 of the container 100 has a tapered portion 111 having an inverted truncated cone shape (tapered shape) that expands outward toward an upper side (upper opening 101 side), an upper side portion 113 that is continuous between the tapered portion 111 and the upper opening 101, and a lower side portion 114 that is continuous between the tapered portion 111 and the bottom portion 120. The tapered portion 111 of the body portion 110 has, for example, a linear and uniform tapered shape in a cross-sectional view, and an angle θ thereof is 5°.

Further, the upper side portion 113 and the lower side portion 114 do not expand outward and have an approximately cylindrical shape.

The tapered portion 111 of the container 100 is formed with a uniform outward expanding angle from 10% height to 90% height from a horizontal plane with a total height of the container being 100% when the container 100 is placed on the horizontal plane with the bottom portion 120 facing downward, so the outward expanding angle of a line connecting an outer peripheral face at the 10% height and an outer peripheral face at the 90% height from the lowermost portion (body taper angle), with a total height of the container being 100% is approximately 5°, which is substantially the same as θ.

In the present embodiment, the bottom portion 120 is formed into a similar shape to that of the well-known two-piece beverage cans.

A fringe of the upper opening 101, that is, the upper end portion of the body portion 110 is formed into a shape in which a sharp edge thereof does not come into direct contact with a mouth, for example, a curled shape, for use as a cup.

An embodiment of the method for manufacturing a container according to the disclosure will be described below.

The container 100 includes a cup body forming step of forming a metal sheet (blank) into a bottomed cylindrical shape having a cylindrical portion with substantially the same diameter to obtain a cup body 200, and a bottom drawing step of forming the tapered portion 111 that expands outward toward an upper opening 101 side by further drawing the obtained cup body 200 so that the diameter narrows toward a bottom portion 220 side. After the bottom drawing step, a curl forming step of curling an upper end portion of the body portion 110 into a round shape is performed. Note that the curl forming step may be performed before the bottom drawing step or in the middle of a plurality of bottom drawing steps.

In the disclosure, the bottom drawing step is performed a plurality of times.

The number of repetitions of the bottom drawing step varies depending on the desired size of the container 100, the body taper angle, and the thickness of the sheet metal from which the cup body 200 is formed, and is preferably from 2 to 50 times, more preferably from 5 to 40 times, still more preferably from 10 to 30 times, and particularly preferably 20 times.

When the number of repetitions of the bottom drawing step is excessive, an increase in the number of steps may increase the manufacturing load and manufacturing costs, and large influence of forming heat may cause non-negligible variations in finished dimensions, resulting in low yields and low productivity. On the other hand, when the number of repetitions of the bottom drawing step is insufficient, there is a risk that the predetermined height range of the body portion 110 cannot be formed into a desired tapered shape, or that a smooth tapered shape cannot be obtained at the tapered portion 111.

In the bottom drawing step, a manufacturing apparatus is used that includes a diameter reducing die 300 having a hole portion 340 with a smaller diameter than an outer diameter of the cylindrical portion of the cup body 200 and an air mechanism that causes gas to flow inside the cup body 200 to apply pressure.

An inner face of the hole portion 340 has a tapered face 341 that expands at the same taper angle over the entire face that serves as a working face for diameter reduction, and a flank 342 that expands diagonally upward and outward continuously from the tapered face 341 on a small diameter side. The taper angle of the tapered face 341 is set to match the desired body taper angle of the tapered portion 111 of the container 100, which is 5° in this embodiment.

The diameter reducing die 300 can be reciprocated with a predetermined stroke length by a drive mechanism (not illustrated).

The apparatus for manufacturing a container according to the disclosure includes a plurality of bottom drawing dies with the diameter reducing dies 300 having the hole portions 340 with different inner diameters from each other. In the individual bottom drawing steps, the diameter reducing dies 300 having the hole portions 340 with different inner diameters from each other are used. When the minimum inner diameters of the hole portions 340 of the diameter reducing dies 300 used for the first, second, . . . , nth bottom drawing steps are d1, d2, . . . , dn, respectively, d1>d2> . . . >dn.

The taper angles of the tapered faces 341 of the hole portions 340 of the diameter reducing dies 300 used in the individual bottom drawing steps are substantially the same.

The minimum inner diameter of the hole portion 340 of the diameter reducing die 300 used in the (n−1)th bottom drawing step is substantially the same as the maximum inner diameter of the hole portion 340 of the diameter reducing die 300 used in the subsequent nth bottom drawing step, or the minimum inner diameter of the hole portion 340 of the diameter reducing die 300 used in the (n−1)th bottom drawing step is smaller than the maximum inner diameter of the hole portion 340 of the diameter reducing die 300 used in the nth bottom drawing step.

The lengths of the tapered faces 341 of the hole portions 340 of the diameter reducing dies 300 used in the individual bottom drawing steps (axial lengths of the hole portions 340) are substantially the same, and a specific length is determined by the height of the tapered portion 111 in the body portion 110 of the desired container 100 and the number of repetitions of the bottom drawing step.

The taper angles and the axial lengths of the tapered faces 341 of the hole portions 340 in the individual diameter reducing dies 300 are not limited to the same dimensions, and need only be set to dimensions suitable for the specific cup shape of the desired container 100, respectively. For example, the tapered face 341 may be curved. The minimum inner diameters and the maximum inner diameters of the hole portions 340 of the individual diameter reducing dies 300 also need only be set to dimensions suitable for the specific cup shape of the desired container 100, respectively.

Figure 2A:
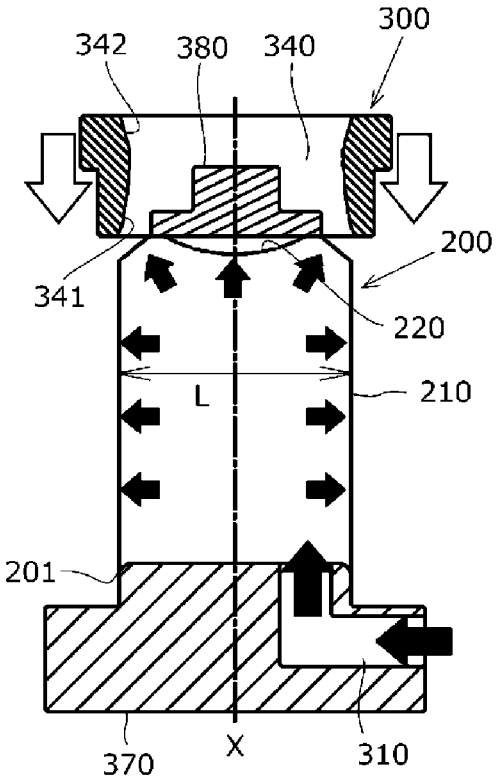
FIG. 2A is a schematic diagram for describing the method for manufacturing a container according to the embodiment of the disclosure.
Figure 2B:
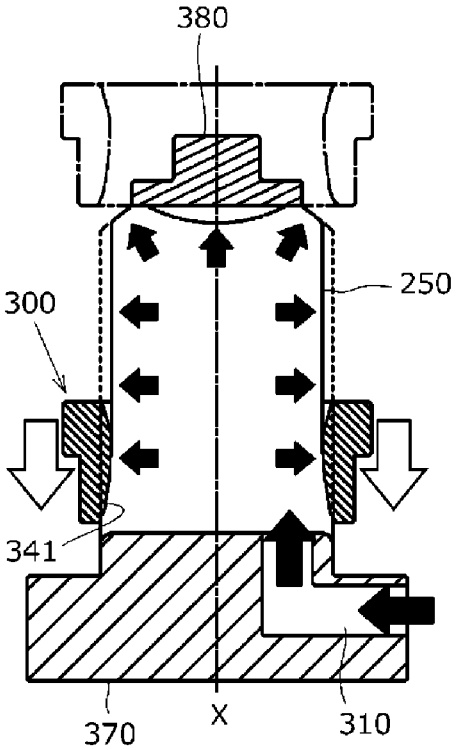
FIG. 2B is a schematic diagram for describing the method for manufacturing the container illustrated in FIG. 2A according to the embodiment.
Figure 2C:
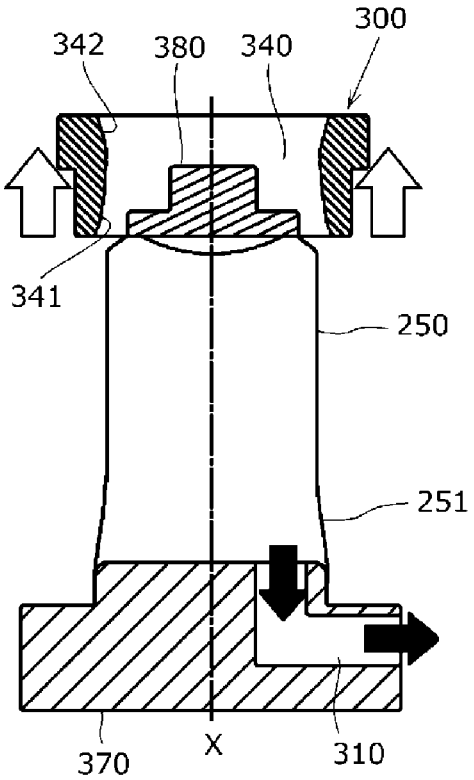
FIG. 2C is a schematic diagram for describing the method for manufacturing the container illustrated in FIG. 2A according to the embodiment.

In the bottom drawing step, as illustrated in FIG. 2A, the cup body 200 is first placed between a base 370 and a support fixture 380 with an open end portion 201 side facing the base 370 side, then the diameter reducing die 300 is coaxially placed in such a posture that the tapered face 341 expands toward a bottom portion 220 of the cup body 200 (a truncated cone shape that expands downward in FIG. 2A). Then, as illustrated in FIG. 2B, the diameter reducing die 300 is relatively moved along the direction of the cylindrical axis X from the bottom portion 220 side of the cup body 200 to a predetermined position (moved downward in FIG. 2B) with gas flowing from a pressurized air source (not illustrated) through an air introduction channel 310 into the cup body 200 by the air mechanism to apply pressure. When the diameter reducing die 300 is moved, the tapered face 341 of the hole portion 340 comes in contact with an outer peripheral face of a peripheral wall 210 of the cup body 200, and the peripheral wall 210 of the cup body 200 is squeezed and reduced in diameter by the hole portion 340 of the diameter reducing die 300. Then, as illustrated in FIG. 2C, a diameter reduced cylindrical portion 250 having a cylindrical shape and an outer diameter in accordance with the minimum inner diameter of the hole portion 340 of the diameter reducing die 300, and a tapered cylindrical portion 251 having a tapered shape corresponding to the tapered face 341 of the diameter reducing die 300 are formed. A part of the peripheral wall that was not in contact with the diameter reducing die 300 due to stoppage of the diameter reducing operation becomes the upper side portion 113 of the container 100.

In the subsequent bottom drawing step, by performing the similar operation using a diameter reducing die having a smaller diameter hole portion, a new tapered cylindrical portion is formed so as to be smoothly connected to the diameter reduced cylindrical portion 250 on the most open end portion 201 side formed in the preceding bottom drawing step, that is, to the tapered cylindrical portion 251 on the bottom portion 220 side formed in the preceding bottom drawing step.

A part of the diameter reduced cylindrical portion having a cylindrical shape that remains without being formed into a tapered shape in the final bottom drawing step becomes the lower side portion 114 of the container 100.

By repeating the above-described bottom drawing step, a plurality of tapered cylindrical portions 251 are smoothly connected to form the tapered portion 111, thereby obtaining the container 100 with the body portion 110 having the tapered portion 111 formed with a uniform outward expanding angle.

The pressure applied by the air mechanism is such that the pressing force of the diameter reducing die 300 does not unintentionally distort the peripheral wall 210 or the bottom portion 220 of the cup body 200, and is specifically, from 0.05 to 0.40 MPa, preferably from 0.1 to 0.3 MPa.

When the pressure applied by the air mechanism is too small, there is a risk of buckling of the cup body 200 during the bottom drawing due to the pressing force by the diameter reducing die 300. On the other hand, when the pressure applied by the air mechanism is excessive, there is a risk of deformation of the bottom portion 220 of the cup body 200, such as inversion, or an increase in manufacturing costs due to an unnecessary increase in air usage.

The draw ratio in the bottom drawing step varies depending on the body taper angle of the tapered portion 111 of the container 100 to be manufactured, and is preferably from 5 to 35%, more preferably from 10 to 30%, and 20% in this embodiment.

The draw ratio is the total draw ratio in all the bottom drawing steps repeated a plurality of times. When the diameter of the cup body 200 before the first bottom drawing step (can to be processed) is L, and the minimum diameter of the tapered portion 111 of the container 100 after the final (nth) bottom drawing step is A, the draw ratio is represented by $(L-A)/L\times100(\%)$ (Expression (1)).

The smaller the draw ratio, the easier it is for the metal material to be plastically deformed, and the tapered portion 111 having a desired tapered shape can be obtained without damage. When the draw ratio is excessive, there is a risk that the tapered portion 111 of the container 100 will break.

As a sheet metal, similar to well-known two-piece beverage cans made of an aluminum alloy, a sheet metal of an aluminum alloy having a thickness of from 0.20 mm to 0.35 mm laminated with polyethylene terephthalate (PET) films having a thickness of approximately 0.01 mm on both sides is used.

By using such a sheet metal, after forming the container, the thickness of the bottom portion in which the thickness of the material is substantially maintained is from 0.20 mm to 0.35 mm, and the thickness of the body portion 110 in the height range of 50±10%, when the total height of the container is 100%, has a thickness of from 0.10 to 0.22 mm.

Figure 3:
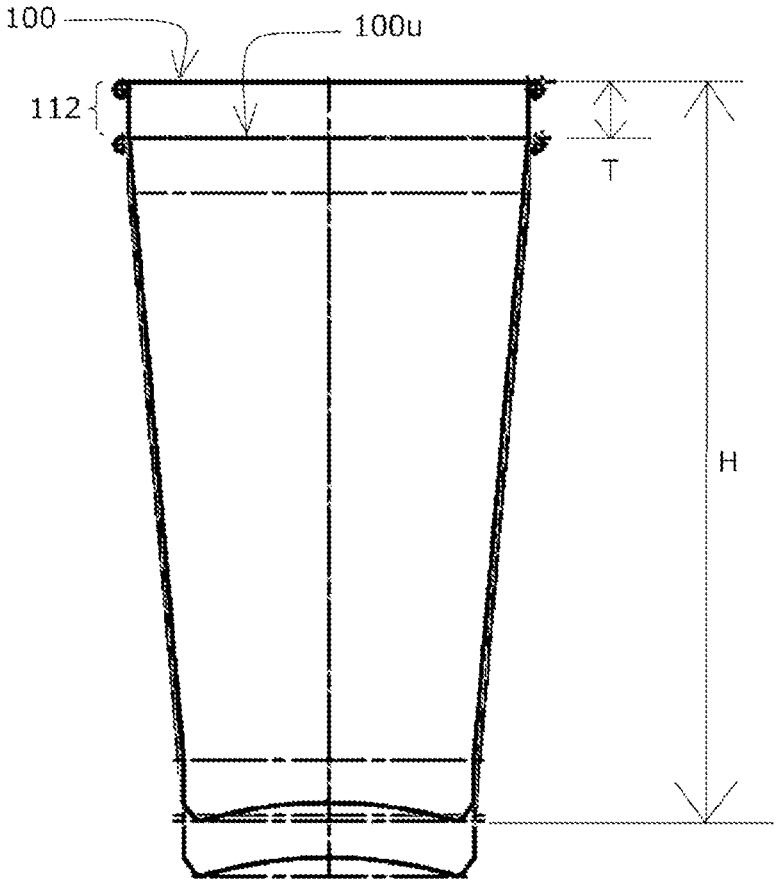
FIG. 3 is a side view of two containers, one illustrated in FIG. 1, stacked on top of each other.
Figure 4:
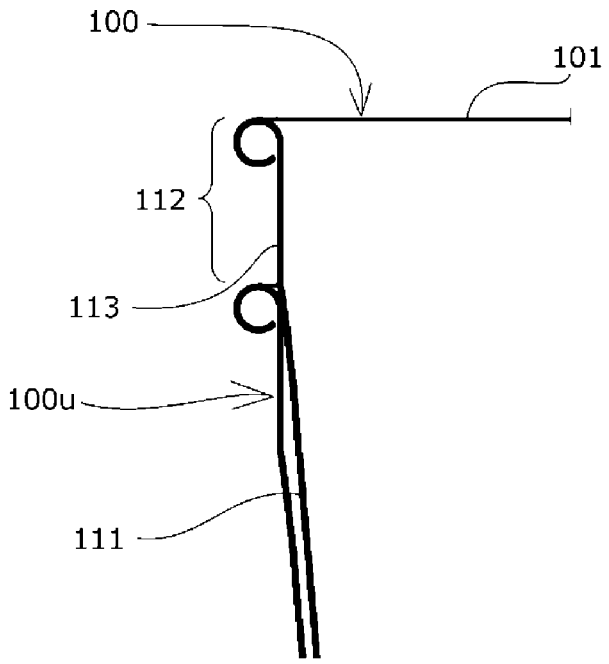
FIG. 4 is a partially enlarged cross-sectional view of the two containers stacked on top of each other illustrated in FIG. 3.

When the containers 100 according to the disclosure are stacked as illustrated in FIGS. 3 and 4, at least one of the following areas (1) and (2) overlaps in contact: (1) a vicinity of an upper end of the outer face of the tapered portion 111 of the container 100 placed above and a vicinity of an upper end of the inner face of the upper side portion 113 of a container 100*u* placed below, and (2) a vicinity of a lower end of the outer face of the lower side portion 114 of the container 100 placed above and a vicinity of a lower end of the inner face of the tapered portion 111 of the container 100*u* placed below, and the outer face of the tapered portion 111 of the container 100 placed above and the inner face of the tapered portion 111 of the container 100*u* placed below do not come into close contact with each other by face.

On an upper end side of the container 100 above, a projecting portion 112 projects from an upper end of the container 100*u* below, and a projecting height T of the projecting portion 112 is determined by a height of the upper side portion 113, a height of the lower side portion 114, a shape of the bottom portion 120, and the like.

In the example in FIG. 3, the projecting height T is 8.0 mm, and the ratio of the height T of the projecting portion to a height H of the container 100 is 7.1%.

Note that the upper side portion 113 and the lower side portion 114 may be formed so as to expand outward at angles different from the angle of the tapered portion 111, or only one of them may be provided, or neither may be provided.

Further, the upper side portion 113 and the lower side portion 114 may be tapered oppositely to the tapered portion 111 so as to narrow inward.

In a case in which the upper side portion 113 and the lower side portion 114 do not exist, or are extremely small so that when stacked, the outer face of the bottom portion 120 of the container 100 placed above and the inner face of the bottom portion 120 of the container 100*u* placed below can be in close contact, a bead, which is an independent contact portion that projects to an inner face side of the body portion 110 and comes into contact with an outer face of the container stacked above, may be provided, thereby preventing the outer face of the body portion 110 of the container 100 placed above and the inner face of the body portion 110 of the container 100*u* placed below from coming into close contact with each other.

The bead may be of any shape, direction, quantity, and location, may project to the inner face side, may project to the outer face side, or a mixture of the inner and outer faces may exist.

Further, as long as a projecting portion functions as a contact portion, the projecting portion may be a point or a face projecting from the tapered portion 111 rather than the bead shape.

Further, the container 100 may be used as a can filled with a beverage or the like and subsequently provided with a lid member.

The lid member may be any stay-on-tab lid made of metal, a sheet made of a layered body, a screw lid, or the like.

In a case in which the lid member is wound and tightened on the upper end of the body portion as a stay-on-tab lid, the upper end of the body portion of the container need only be subjected to trimming for the winding and tightening and subsequently subjected to flanging that forms a face portion.

In a case in which the lid member is bonded by heat or other means to the upper end of the body portion as a sheet composed of a layered body, the upper end of the body portion of the container may be imparted with a shape that includes a face portion to ensure the bonding area. Examples of the sheet composed of a layered body include aluminum foil, paper, a resin film, and a laminate material obtained by layering two or more of these, and a thermal adhesive layer (heat-sealed layer) may be further layered. As the thermal adhesive layer, a layer composed of an adhesive such as a known sealant film, a lacquer type adhesive, an easy peel adhesive, or a hot melt adhesive can be employed.

In a case in which the lid member is screw-fixed to the upper end of the body portion as a screw lid, the projecting portion 112 of the upper side portion 113 or the like of the upper end of the body portion of the container may include screw threads, or a lid member with a spout including separate screw threads may be wound and tightened around the upper end of the body portion of the container to screw-fix the screw lid.

By matching the projecting portion 112 to the attachment form of the lid member, it is possible to improve efficiency when storing and transporting the container portion regardless of the type of lid member.

The method for manufacturing a container and the apparatus for manufacturing a container according to the embodiment of the disclosure have been described in detail above, but the disclosure is not limited to the embodiment described above, and various changes can be made within the scope of the disclosure described in the claims.

For example, in the method for manufacturing a container according to the disclosure, not only the container in which the tapered portion of the body portion is formed into the shape that expands outward at the body taper angle of from 2° to 15° at any location, but also following containers can be manufactured: a container partially having a portion outside the range of from 2° to 15° similar to the upper side portion and the lower side portion in the present embodiment, a curved container in which the outward expanding of the body portion gradually changes in a cross-sectional view, and a container having a plurality of stepped portions on the body portion, and a container having a body portion with a combination of linear expanding, curved expanding, stepped portions, and the like.

Figure 5A:
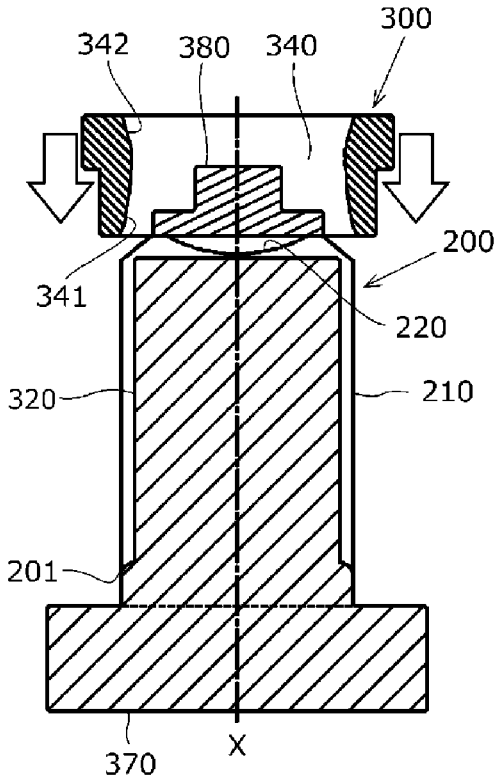
FIG. 5A is a schematic diagram for describing a method for manufacturing a container according to another embodiment of the disclosure.

For example, as illustrated in FIG. 5A, instead of the air mechanism, a bottom drawing die may be provided with a core tool 320 that is disposed inside the cup body and supports the inner face of the peripheral wall 210 of the cup body 200.

Figure 5B:
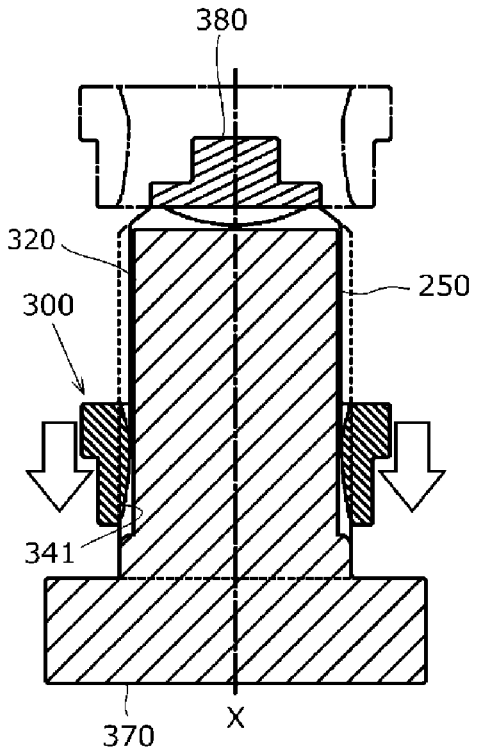
FIG. 5B is a schematic diagram for describing the method for manufacturing the container illustrated in FIG. 5A according to the other embodiment.
Figure 5C:
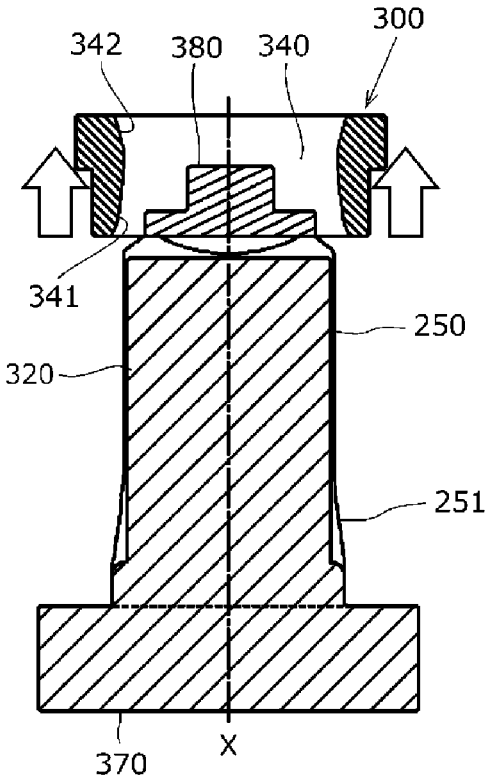
FIG. 5C is a schematic diagram for describing the method for manufacturing the container illustrated in FIG. 5A according to the other embodiment.

In a bottom drawing step using the core tool 320, as illustrated in FIG. 5A, the core tool 320 is first disposed inside the cup body 200 between the base 370 and the support fixture 380 with the open end portion 201 side of the cup body 200 facing the base 370 side, then the diameter reducing die 300 is coaxially placed in such a posture that the tapered face 341 expands toward the bottom portion 220 of the cup body 200 (a truncated cone shape that expands downward in FIG. 5A). In this state, as illustrated in FIG. 5B, the diameter reducing die 300 is relatively moved along the direction of the cylindrical axis X from the bottom portion 220 side of the cup body 200 to squeeze the peripheral wall 210 of the cup body 200 to reduce the diameter in the same manner as in FIG. 2B. Then, as illustrated in FIG. 5C, in the same manner as in FIG. 2C, the diameter reduced cylindrical portion 250 having a cylindrical shape and an outer diameter in accordance with the minimum inner diameter of the hole portion 340 of the diameter reducing die 300, and the tapered cylindrical portion 251 having a tapered shape corresponding to the tapered face 341 of the diameter reducing die 300 are formed. A part of the peripheral wall that was not in contact with the diameter reducing die 300 due to stoppage of the diameter reducing operation becomes the upper side portion 113 of the container 100.

In the subsequent bottom drawing step, by performing the similar operation using a diameter reducing die having a smaller diameter hole portion and a core tool having a smaller diameter, a new tapered cylindrical portion is formed so as to be smoothly connected to the diameter reduced cylindrical portion 250 on the most open end portion 201 side formed in the preceding bottom drawing step, that is, to the tapered cylindrical portion 251 on the bottom portion 220 side formed in the preceding bottom drawing step.

A part of the diameter reduced cylindrical portion having a cylindrical shape that remains without being formed into a tapered shape in the final bottom drawing step becomes the lower side portion 114 of the container 100.

By repeating the above-described bottom drawing step, a plurality of tapered cylindrical portions 251 are smoothly connected to form the tapered portion 111, thereby obtaining the container 100 with the body portion 110 having the tapered portion 111 formed with a uniform outward expanding angle.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A method for manufacturing a cup made of metal, including a bottom portion and a body portion, open on an upper face side, and having a shape in which the body portion expands outward toward the upper face side, the method comprising:

(a) reducing a diameter of a cup body made of metal and having a bottomed cylindrical shape by operating a diameter reducing die having a hole portion with a smaller diameter than an outer diameter of the cup body along a cylindrical axis direction from a bottom side, wherein step (a) is repeated a plurality of times, wherein in step (a), pressure is applied to an inside of the cup body by inflow of gas into the cup body.

2. The method for manufacturing a cup according to claim 1, wherein step (a) is repeated a plurality of times by using a plurality of diameter reducing dies, and a diameter of a hole portion of a diameter reducing die used in step (a) performed earlier is greater than a diameter of a hole portion of a diameter reducing die used in step (a) performed subsequently.

3. The method for manufacturing a cup according to claim 1, wherein in step (a), a core tool configured to support an inner face of a peripheral wall of the cup body is disposed inside the cup body.

4. The method for manufacturing a cup according to claim 1, wherein the pressure applied to the inside of the cup body is from 0.05 to 0.40 MPa.

5. The method for manufacturing a cup according to claim 1 or 2, wherein step (a) is repeated from 5 to 40 times.

6. The method for manufacturing a cup according to claim 1 or 2, wherein by the step (a), the body portion of the cup is formed into a shape in which an outer peripheral face thereof has a tapered face from a lowest position at 10% height of the cup to a highest position at 90% height of the cup, the tapered face having a tapered angle of from 2° to 15°, and a distance of a projecting portion from the top of the cup to the 90% height of the cup is 20 mm or less.

7. The method for manufacturing a cup container according to claim 6, wherein the bottom portion has a thickness of from 0.20 mm to 0.35 mm, the body portion has a thickness of from 0.10 to 0.22 mm in a height range of 50±10% when the total height of the cup is 100%, and the tapered face has the tapered angle of from 3° to 10°.

8. The method for manufacturing a cup container according to claim 6, wherein a ratio of the projecting portion to a height of the cup is from 4% to 15%.

9. The method for manufacturing a cup according to claim 6, wherein a ratio of the projecting portion to a height of the cup is from 5% to 9%.

10. The method for manufacturing a cup according to claim 6, wherein the body portion includes a contact portion with a less area configured to avoid close contact with another cup when the cup is stacked with the another cup.

11. An apparatus for manufacturing a container made of metal, including a bottom portion and a body portion, open on an upper face side, and having a shape in which the body portion expands outward toward the upper face side, the apparatus comprising:

a plurality of bottom drawing dies including diameter reducing dies that have hole portions with smaller diameters than an outer diameter of a cup body made of metal and having a bottomed cylindrical shape and are configured to reduce a diameter of the cup body along a cylindrical axis direction from a bottom side of the cup body, wherein the plurality of bottom drawing dies include an air mechanism configured to apply pressure to an inside of the cup body by inflow of gas into the cup body, wherein the apparatus performs (a) reducing the diameter of the cup body by operating the diameter reducing die along the cylindrical axis direction from the bottom side, step (a) is repeated a plurality of times, and in step (a), pressure is applied by the air mechanism to the inside of the cup body by inflow of gas into the cup body.

12. The apparatus for manufacturing a container according to claim 11, wherein diameters of the hole portions of the diameter reducing dies included in the plurality of bottom drawing dies are different from each other.

13. The apparatus for manufacturing a container according to claim 11 or 12, wherein the plurality of bottom drawing dies include core tools disposed inside the cup body and configured to support an inner face of a peripheral wall of the cup body.

14. The apparatus for manufacturing a container according to claim 11, wherein the air mechanism applies pressure of from 0.05 to 0.40 MPa to the inside of the cup body.

15. The apparatus for manufacturing a container according to claim 11 or 12, wherein the number of the plurality of bottom drawing dies is from 5 to 40.

* * * * *